US005823047A

United States Patent [19]

Hosoya

[11] Patent Number: 5,823,047

[45] Date of Patent: Oct. 20, 1998

[54] STARTER WITH SEPARATING WALL HAVING SLANTING PORTION

[75] Inventor: Akifumi Hosoya, Kariya, Japan

[73] Assignee: Denso Corporation, Kariya, Japan

[21] Appl. No.: 796,862

[22] Filed: Feb. 6, 1997

[30] Foreign Application Priority Data

Feb. 8, 1996 [JP] Japan ..... 8-022524

[51] Int. Cl.[6] ..... F02N 15/06

[52] U.S. Cl. ..... 74/7 E; 74/7 A; 310/83

[58] Field of Search ..... 74/7 A, 7 E; 310/83, 310/99; 290/48

[56] References Cited

U.S. PATENT DOCUMENTS

| | | | |
|---|---|---|---|
| 4,691,590 | 9/1987 | Geringer et al. | 74/579 E |
| 4,800,766 | 1/1989 | Isozumi et al. | 74/7 E |
| 4,862,027 | 8/1989 | Isozumi et al. | 74/7 E X |
| 5,154,090 | 10/1992 | Konishi | 74/7 E |

FOREIGN PATENT DOCUMENTS 63-168276 11/1988 Japan .

*Primary Examiner*—Allan D. Herrmann

*Attorney, Agent, or Firm*—Cushman Darby & Cushman IP Group of Pillsbury Madison & Sutro LLP

[57] ABSTRACT

A separating wall comprised of a slanting portion, an anti-falling portion and a thrust receiving portion, is provided integrally with a yoke. The slanting portion is formed from the front end of the yoke to the side of a speed reduction mechanism, tilting in the inner radial direction. The anti-falling portion is formed extending substantially vertically from the slanting portion to the inner radial direction preventing planetary gears of the speed reduction mechanism from coming-off mounting pins, by way of contacting the pins supporting the planetary gears and the end surface of a bearing. The thrust receiving portion supports a shaft rotatably via a bearing fitted with the shaft and receives thrust load of the shaft. The thrust receiving portion is cylindrically shaped and bent from the anti-falling portion to the side of an armature core. The cylindrical portion of the thrust receiving portion is pressed and fitted around the outer periphery of the bearing fitted to the shaft.

14 Claims, 2 Drawing Sheets

STARTER WITH SEPARATING WALL HAVING SLANTING PORTION

BACKGROUND OF THE INVENTION

1. Field of the Invention:

The present invention relates to a starter for starting an engine.

2. Description of Related Art:

A starter having an electromagnetic switch disposed coaxially with a motor shaft is conventionally known (JP-U-63-168276). The starter has a face-type commutator having an abutting surface with brushes at a right angle with respect to a rotary shaft of an armature. In this starter, a collar portion is formed around the outer periphery of the rotary shaft of the armature and a bearing of the rotary shaft engages the collar portion in the thrust direction. Also, another bearing engages the inner circumferential cylindrical portion of a flange formed by bending an end portion of a yoke towards the inner radial direction. Thus, a thrust load affecting the armature is received in the conventional starter. The flange works as a separating wall separating a planetary gear speed reduction mechanism from a motor. At the same time, it functions as an anti-falling means of the planetary gears.

However, in the above-mentioned starter, both end surfaces of the bearing supporting the planetary gears and the end surface of a supporting shaft supporting the bearing contact slidably with the flange along with movement, i.e. rotating and revolving, of the planetary gears. Therefore, the generated sliding sound or engaging sound of gears in the planetary gear speed reduction mechanism make considerable noise because the flange operates as a resonating board.

Also, the thrust load affecting the armature is received by the flange and, vibrations caused by the rotation of the armature is transmitted to the flange.

Therefore, if the rotational speed of the armature increases, there is a possibility that a vibrational frequency transmitted to the flange might coincide with the specific vibrational frequency of the flange, resulting in increased noise due to the resonance. Especially, in case that the motor is made compact by increasing the speed reduction ratio, the rotational speed of the armature is increased. Accordingly, the frequency of vibrations generated in the flange becomes larger, which is disadvantageous from the standpoint of noise reduction.

Further, when the resonance of the flange is transmitted to the rotary shaft of the armature through its bearing, the armature vibrates in the axial direction. In this case, if the brushes can not keep up with the vibration of the armature, they are prone to attach or detach to and from the armature (brush-jumping) causing a deterioration in the rectification.

SUMMARY OF THE INVENTION

In light of the above-described problems, the present invention has an object of providing a starter which reduces the noise caused along with the vibrations of a separating wall.

According to the first aspect of the present invention, the vibration of a separating wall is decreased by a slanting portion formed on the separating wall. The deflection of the separating wall in the axial direction is decreased compared with a flat-shaped flange. As a result, the noise generated from the resonating effect of the separating wall is decreased.

Preferably, an anti-falling portion and the slanting portion have respective continuously curved surfaces with respective curvatures. Therefore, rigidity of the separating wall improves so that the noise is by far reduced.

According to another aspect of the present invention, rib portions are provided on a the separating wall to suppress vibrations of the separating wall and thereby to reduce noise.

Preferably, the separating wall is formed integrally with a yoke to reduce the number of parts required. Centering of a shaft is thus facilitated since there is no connecting part which connects the yoke with the separating wall.

Preferably, the overall axial length of a starting motor is reduced by adopting a face-type commutator.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

(First Embodiment)

Figure 1:
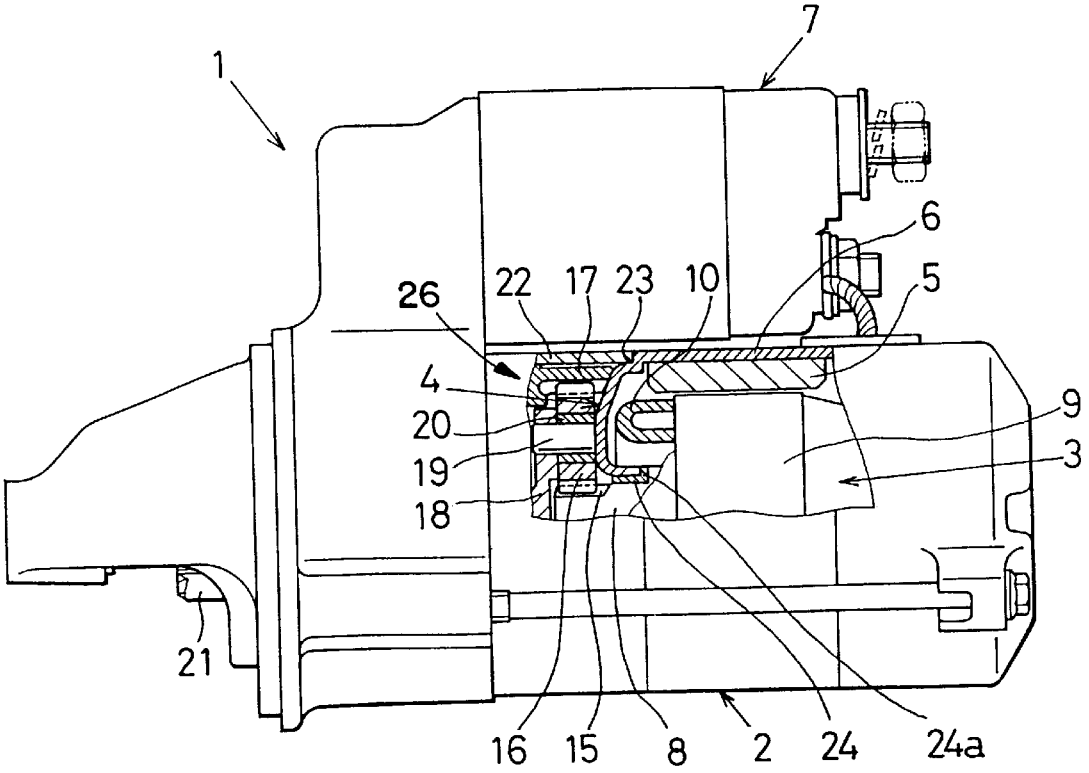
FIG. 1 is a cross-sectional view of a major part of a starter according to a first embodiment of the present invention.

In FIG. 1 showing a first embodiment, a starter 1 is a speed reduction type starter having a planetary gear speed reduction mechanism 26 (explained below) for reducing the rotational speed of an armature 3 of a starting motor 2. Except for a separating wall 4 separating the speed reduction mechanism from starting motor 2, the starter 1 has a conventional structure.

Starting motor 2 is comprised of armature 3, fixed poles 5 (permanent magnets) disposed around the outer periphery of armature 3, a cylindrical yoke 6 for fixing fixed poles 5 to the inner circumferential surface thereof and the like. When a starter switch (not shown) is turned on and a motor-contact (not shown) built in a magnet switch 7 is closed, armature 3 is supplied with electricity to rotate.

Figure 2A:
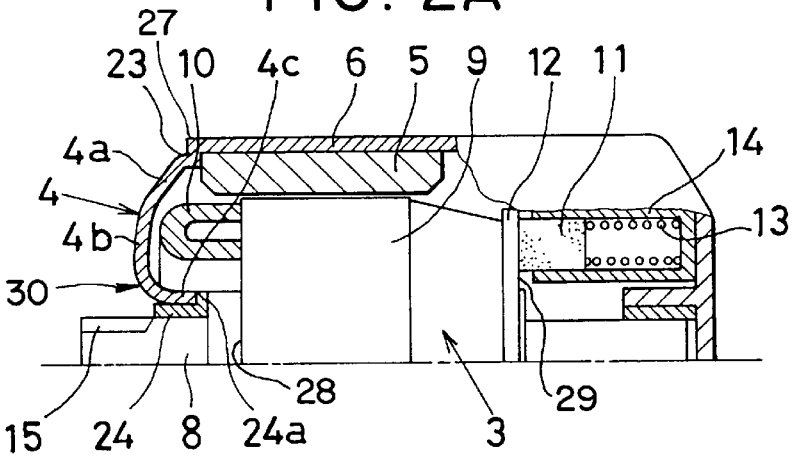
FIG. 2A is a halved cross-sectional view of a starting motor including a separating wall according to the first embodiment of the present invention.

As shown in detail in FIG. 2A, armature 3 is comprised of a shaft 8 supported rotatably, an armature core 9 fixed to the outer periphery of shaft 8, an armature coil 10 wound around armature core 9, a face-type commutator 12 whose abutting surface 29 with brushes 11 is at a right angle with respect to shaft 8, and so on. Each brush 11 and a biasing spring 13 are held by a brush holder 14. Brush 11 is also pressed against commutator 12 by spring 13 from the rear side in the axial direction.

The planetary gear speed reduction mechanism 26 is comprised of a sun gear 15 formed around the outer periphery of the front end of shaft 8, a plurality of planetary gears 16 meshing with sun gear 15 and an internal gear 17 meshing with each planetary gear 16. In this speed reduction mechanism, each planetary gear 16 is rotatably supported by a pin 19 press-fitted into a carrier portion 18 formed on the rear end of the output shaft, via bearing 20. Therefore, when sun gear 15 rotates integrally with shaft 8, each planetary gear 16 meshing with sun gear 15 and with internal gear 17 self-rotates and also revolves around the outer periphery of sun gear 15. Since the revolving power is transmitted to carrier portion 18 via pins 19, the output shaft rotates accordingly. A pinion gear 21 is fitted on the output shaft via helical spline for conveying the rotating power of starting motor 2 to an engine ring gear by meshing.

As shown in FIG. 2A, separating wall 4 is comprised of a slanting portion 4*a,* a vertical portion (anti-falling portion) 4*b* and a horizontal portion (thrust receiving portion) 4*c* and is formed integrally with yoke 6. Slanting portion 4*a* is formed from the front arial end 27 of end of yoke 6 to tilt towards the side of the speed reduction mechanism axially and towards the shaft 8 radially. Here, slanting portion 4*a* is connected to the front end of yoke 6 having a stepped portion of a thickness substantially equivalent to the thickness of yoke 6. This stepped portion is provided as fitting or engagement portion 23 in respect with housing 22 covering the radially outer periphery of the speed reduction mechanism.

Anti-falling portion 4*b* is formed to extend vertically from slanting portion 4*a* in the inner radial direction to the inner radial portion 30 preventing planetary gears 16 from coming-off from pins 19, by way of contacting with pins 19 supporting planetary gears 16 and with the end surface of bearing 20.

Thrust receiving portion 4*c* supports shaft 8 rotatably via bearing 24 fitted with shaft 8 and receives thrust load of shaft 8. The thrust receiving portion 4*c* is cylindrically shaped and bent from anti-falling portion 4*b* to the side 28 of armature core 9. The cylindrical portion of thrust receiving portion 4*c* is pressed and fitted around the outer periphery of bearing 24 fitted to shaft 8. A collar portion 24*a* facing the front end surface of thrust receiving portion 4*c* in the axial direction is formed integrally with bearing 24.

Next, function and effect of separating wall 4 will explained.

Separating wall 4 supports shaft 8 in the radial direction via bearing 24 and receives the thrust load (pushing force of spring 13 pressing brushes 11 in the axial direction) through collar portion 24*a* of bearing 24. Therefore, vibration corresponding to the rotation of armature 3 is transmitted to separating wall via bearing 24. Pins 19 supporting planetary gears 16 as well as the end surface of bearing 20 happen to contact with anti-falling portion 4*b* of separating wall 4. Therefore, when armature 3 rotates and the speed reduction mechanism begins operation, sliding sound of pins 19 as well as bearing 20 with anti-falling portion 4*b* or engaging sound of gears 15, 16 and 17 of the speed reduction mechanism, are generated. However, since separating wall 4 has slanting portion 4*a* between yoke 6 and anti-falling portion 4*b* to have the higher rigidity, the vibration is suppressed. Therefore, the vibration due to the rotation of armature 3, the sliding sound generated by pins 19 as well as bearing 20 with anti-falling portion 4*b,* and the resonance of the engaging sound of gears 15, 16 and 17 are prevented. Thus, the noise can be reduced.

Also, the vibration of armature 3 in the axial direction is prevented by the suppression of the resonance of separating wall 4. As a result, since brushes 11 do not detach from commutator 12, the deterioration in rectification is prevented.

Further, in this embodiment, internal gear 17 can be enlarged axially to the side of yoke 6 by slanting portion 4*a* of separating wall 4. Thus, a gear strength of internal gear 17 improves.

(Variation)

Though slanting portion 4*a* is provided between anti-falling portion 4*b* and yoke 6 in this embodiment, it is also possible to provide slanting portion 4*a* between anti-falling portion 4*b* formed directly from the front end of yoke 6 and thrust receiving portion 4*c*. Slanting portion 4*a* may alternatively be provided on both radial sides of anti-falling portion 4*b* (the side of yoke 6 and the side of thrust receiving portion 4*c*).

Figure 2B:
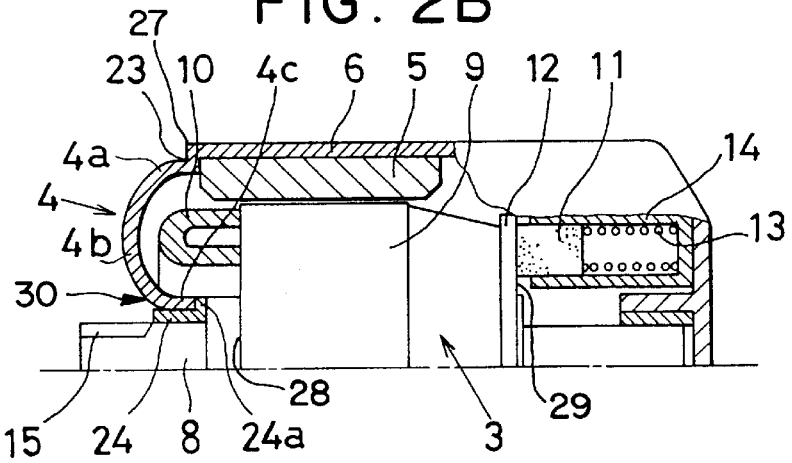
FIGS. 2B is a halved cross-sectional view of a variation of the first embodiment.

Further, as shown in FIG. 2B, separating wall 4 may be comprised of two curved portions, i.e., slanting portion 4*a* and anti-falling portion 4*b* having respective curvatures, connected continuously, except for thrust receiving portion 4*c* pressed into bearing 24. The center of the curvature of separating wall 4 can be either at the side of armature 3 or at the side of the speed reduction mechanism. Thus, the rigidity of separating wall improves.

(Second Embodiment)

Figure 3A:
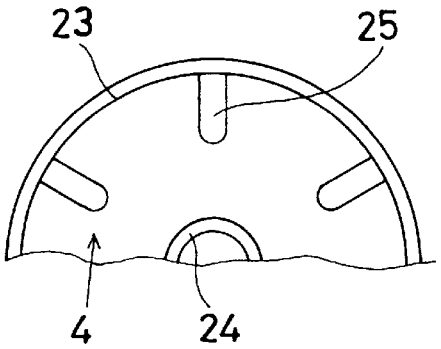
FIGS. 3A and 3B are a front view and a cross-sectional view of the separating wall respectively according to a second embodiment of the present invention.
Figure 3B:
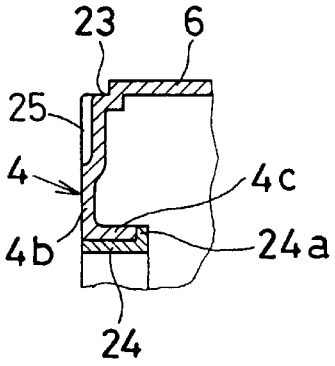

As shown in FIGS. 3A and 3B, ribs 25 are provided more outer-circumferentially than anti-falling portion 4*b* of separating wall 4. Since the rigidity of separating wall 4 improves also, the vibration of armature 3 is suppressed resulting in reducing noise.

Although ribs 25 are provided at the side of the speed reduction mechanism in FIG. 3B, these can be provided at the side of the armature 3.

The present invention should not be restricted to the disclosed embodiments but may be modified in many other ways without departing from the spirit and the scope of the invention.

What is claimed is:

1. A starter comprising:

a starting motor including a shaft, a yoke, and an armature provided in an inner circumference of said yoke, said armature including an armature core fixed to said shaft;

a planetary gear speed reduction mechanism, for reducing rotational speed of said armature, disposed axially adjacent to said starting motor and including a sun gear provided on said shaft, planetary gears meshing with said sun gear, and an internal gear meshing with said planetary gears; and a separating wall provided between said starting motor and said planetary gear speed reduction mechanism to extend from said yoke radially inwardly toward said shaft, said separating wall being formed in a continuous curved shape of different curvatures over an entire radial length thereof.

2. A starter according to claim 1, wherein:

said separating wall has an anti-falling portion between an outer radial portion thereof and an inner radial inner portion thereof axially facing said planetary gears.

3. A starter according to claim 2, wherein:

centers of said different curvatures of said separating wall are arranged to be at a side of said armature.

4. A starter according to claim 3, wherein:

said separating wall is integral with said yoke.

5. A starter according to claim 4, wherein:

said separating wall has a stepped part at a joint between said outer radial portion and said yoke.

6. A starter comprising:

a starting motor including a shaft, a yoke, and an armature having an armature core fixed to said shaft, said armature being provided in an inner circumference of said yoke;

a planetary gear speed reduction mechanism for reducing rotational speed of said armature, said planetary gear speed reduction mechanism including a sun gear provided on said shaft, planetary gears rotatably mounted on pins and meshing with said sun gear and an internal gear meshing with said planetary gears; and a separating wall including a thrust receiving portion for receiving a thrust load exerted on said armature and provided between said starting motor and said planetary gear speed reduction mechanism to extend from an axial end of said yoke in an inner radial direction, an inner radial portion of said separating wall extending to a side of said armature core, wherein said separating wall is provided with:

an anti-falling portion disposed between said axial end of said yoke and said thrust receiving portion for preventing said planetary gears from coming-off said pins, and a slanting portion tilting in an axial direction with respect to said anti-falling portion, said anti-falling portion and said slanting portion of said separating wall being formed by continuous curved surfaces having respective curvatures.

7. A starter according to claim 6, wherein:

said slanting portion is provided between said axial end of said yoke and said anti-falling portion.

8. A starter according to claim 6, wherein:

said slanting portion is provided between said anti-falling portion and said thrust receiving portion.

9. A starter according to claim 6, wherein:

centers of said curvatures of said anti-falling portion and said slanting portion are arranged to be at a side of said armature.

10. A starter according to claim 6, wherein:

said separating wall is provided integrally with said yoke.

11. A starter according to claim 6, wherein:

said starting motor includes a face-type commutator and brushes which operatively engage with an abutting surface of said commutator, wherein said abutting surface makes a substantially right angle with respect to said shaft.

12. A starter comprising:

a starting motor including a shaft, a yoke, and an armature having an armature core fixed to said shafts said armature being provided in an inner circumference of said yoke;

a planetary gear speed reduction mechanism for reducing rotational speed of said armature, said planetary gear speed reduction mechanism including a sun gear provided on said shaft, planetary gears meshing with said sun gear and an internal gear meshing with said planetary gears;

a separating wall including a thrust receiving portion for receiving a thrust load exerted on said armature and provided between said starting motor and said planetary gear speed reduction mechanism to extend from an axial end of said yoke in an inner radial direction, an inner radial portion of said separating wall extending to a side of said armature core, said separating wall including an anti-falling portion facing the planetary gears, wherein said separating wall is provided with a plurality of ribs formed in said separating wall at a portion of said separating wall located radially outwardly from said anti-falling portion for improving rigidity of said separating wall.

13. A starter according claim 12, wherein:

said separating wall is provided integrally with said yoke.

14. A starter according to claim 12 wherein:

said starting motor includes a face-type commutator and brushes which operatively engage an abutting surface of said commutator, wherein said abutting surface makes a substantially right angle with respect to said shaft.

* * * * *